US011015407B2

(12) United States Patent
Watson et al.

(10) Patent No.: US 11,015,407 B2
(45) Date of Patent: May 25, 2021

(54) FLAPPER VALVE TOOL

(71) Applicant: Thru Tubing Solutions, Inc., Oklahoma City, OK (US)

(72) Inventors: Brock Watson, Oklahoma City, OK (US); Roger Schultz, Newcastle, OK (US); Andy Ferguson, Moore, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 15/989,332

(22) Filed: May 25, 2018

(65) Prior Publication Data

US 2018/0274313 A1 Sep. 27, 2018

Related U.S. Application Data

(63) Continuation of application No. 15/058,887, filed on Mar. 2, 2016, now Pat. No. 10,006,261, which is a (Continued)

(51) Int. Cl.
*E21B 21/10* (2006.01)
*E21B 34/14* (2006.01)

(52) U.S. Cl.
CPC ..... *E21B 21/10* (2013.01); *E21B 34/14* (2013.01); *E21B 2200/05* (2020.05); *E21B 2200/06* (2020.05)

(58) Field of Classification Search
CPC ..... E21B 2034/005; E21B 2034/007; E21B 21/10; E21B 34/14; E21B 2200/05; E21B 2200/06
See application file for complete search history.

(56) References Cited

U.S. PATENT DOCUMENTS 3,289,769 A * 12/1966 Nelson ..... E21B 21/10 137/493.9
3,995,692 A * 12/1976 Seitz ..... E21B 21/10 166/318

(Continued)

FOREIGN PATENT DOCUMENTS

WO 2011005826 A1 1/2011
WO 2012048144 4/2012

OTHER PUBLICATIONS

PCT/US2015/014972; International Search Report and Written Opinion; dated May 14, 2015; 16 pages.

(Continued)

*Primary Examiner* — Christopher J Sebesta
(74) *Attorney, Agent, or Firm* — Hall Estill Law Firm

(57) ABSTRACT

A downhole tool having a flapper valve assembly for controlling the backflow of fluid into a tubing string that includes at least one flapper. The downhole tool also includes a deformable element that maintains the at least one flapper in an open position after the deformable portion is deformed. A downhole tool having a flapper valve assembly for controlling the backflow of fluid into a tubing string that includes at least one flapper. The downhole tool also includes a sleeve slidably disposed within at least a portion of the flapper valve assembly and the downhole tool. The downhole tool includes a deformable and dissolvable seat disposed uphole and adjacent to the sleeve and a dissolvable fluid blocking member to engage with the seat to shift the sleeve from first position to a second position within the downhole tool. Methods of using these downhole tools are provided.

20 Claims, 13 Drawing Sheets

Related U.S. Application Data continuation-in-part of application No. 14/615,237, filed on Feb. 5, 2015, now Pat. No. 9,534,460.

(60) Provisional application No. 62/038,049, filed on Aug. 15, 2014.

(56) References Cited

U.S. PATENT DOCUMENTS

| | | | | |
|---|---|---|---|---|
| 4,469,174 | A * | 9/1984 | Freeman | E21B 17/14 166/202 |
| 4,531,587 | A | 7/1985 | Fineberg | |
| 4,729,432 | A | 3/1988 | Helms | |
| 6,679,336 | B2 | 1/2004 | Musselwhite et al. | |
| 6,712,145 | B2 * | 3/2004 | Allamon | E21B 21/10 166/327 |
| 6,712,150 | B1 | 3/2004 | Misselbrook et al. | |
| 8,291,988 | B2 | 10/2012 | King | |
| 8,646,531 | B2 | 2/2014 | King | |
| 2002/0148615 | A1 * | 10/2002 | Szarka | E21B 21/10 166/332.4 |
| 2003/0047315 | A1 * | 3/2003 | Allamon | E21B 21/10 166/332.8 |
| 2004/0065442 | A1 | 4/2004 | Myerley et al. | |
| 2006/0207764 | A1 | 9/2006 | Rytlewski | |
| 2007/0295508 | A1 | 12/2007 | Collins et al. | |
| 2011/0030968 | A1 | 2/2011 | Xu | |
| 2011/0073321 | A1 | 3/2011 | Fay et al. | |
| 2011/0284232 | A1 * | 11/2011 | Huang | E21B 21/103 166/317 |
| 2011/0290344 | A1 | 12/2011 | Groesbeck et al. | |
| 2012/0085548 | A1 * | 4/2012 | Fleckenstein | E21B 34/063 166/373 |
| 2014/0069654 | A1 | 3/2014 | Hofman et al. | |
| 2014/0158361 | A1 * | 6/2014 | Cheng | E21B 23/006 166/308.1 |
| 2014/0202713 | A1 * | 7/2014 | Stewart | E21B 34/14 166/386 |

OTHER PUBLICATIONS

PCT/US2016/020477; International Search Report and Written Opinion; dated Nov. 25, 2016; 18 pages.

* cited by examiner 116
118
118
120
142
126
128
138
124
136
122
82
82
134
130
80
72
140
98

118
118
116
120
126
128
138
136
122
131
134
140
82
82
80
72
98

82
80
82
76
98
72

98
82
80
82
76
72

FLAPPER VALVE TOOL

CROSS-REFERENCE TO RELATED APPLICATIONS

The present application is a continuation-in-part of U.S. patent application having U.S. Ser. No. 15/058,887, filed Mar. 2, 2016, which is a continuation-in-part of U.S. patent application having U.S. Ser. No. 14/615,237, filed Feb. 5, 2015, which claims the benefit of U.S. Provisional Application having U.S. Ser. No. 62/038,049, filed Aug. 15, 2014, which claims the benefit under 35 U.S.C. 119(e), the disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a downhole tool used to control and/or prevent pressurized wellbore fluids from traveling up through the workstring tubing.

2. Description of the Related Art

Traditionally, flapper valves have been used to prevent pressurized wellbore fluids from entering a workstring from the bottom up. Typical flapper valves can wear out after a period of use.

Accordingly, there is a need for a way to be able to reliably maintain a flapper valve in an open position.

SUMMARY OF THE DISCLOSURE

The disclosure is related to a downhole tool having a flapper valve assembly for controlling the backflow of fluid into a tubing string that includes at least one flapper. The downhole tool also includes a deformable element that maintains the at least one flapper in an open position after the deformable portion is deformed. The disclosure is also related to a method of using this downhole tool.

The disclosure is also related to a downhole tool having a flapper valve assembly for controlling the backflow of fluid into a tubing string that includes at least one flapper. The downhole tool also includes a sleeve slidably disposed within at least a portion of the flapper valve assembly and the downhole tool. The downhole tool includes a deformable and dissolvable seat disposed uphole and adjacent to the sleeve and a dissolvable fluid blocking member to engage with the seat to shift the sleeve from first position to a second position within the downhole tool. The disclosure is also related to a method of using this downhole tool.

DETAILED DESCRIPTION OF THE DISCLOSURE

Figures 1A, 1B, 1C:
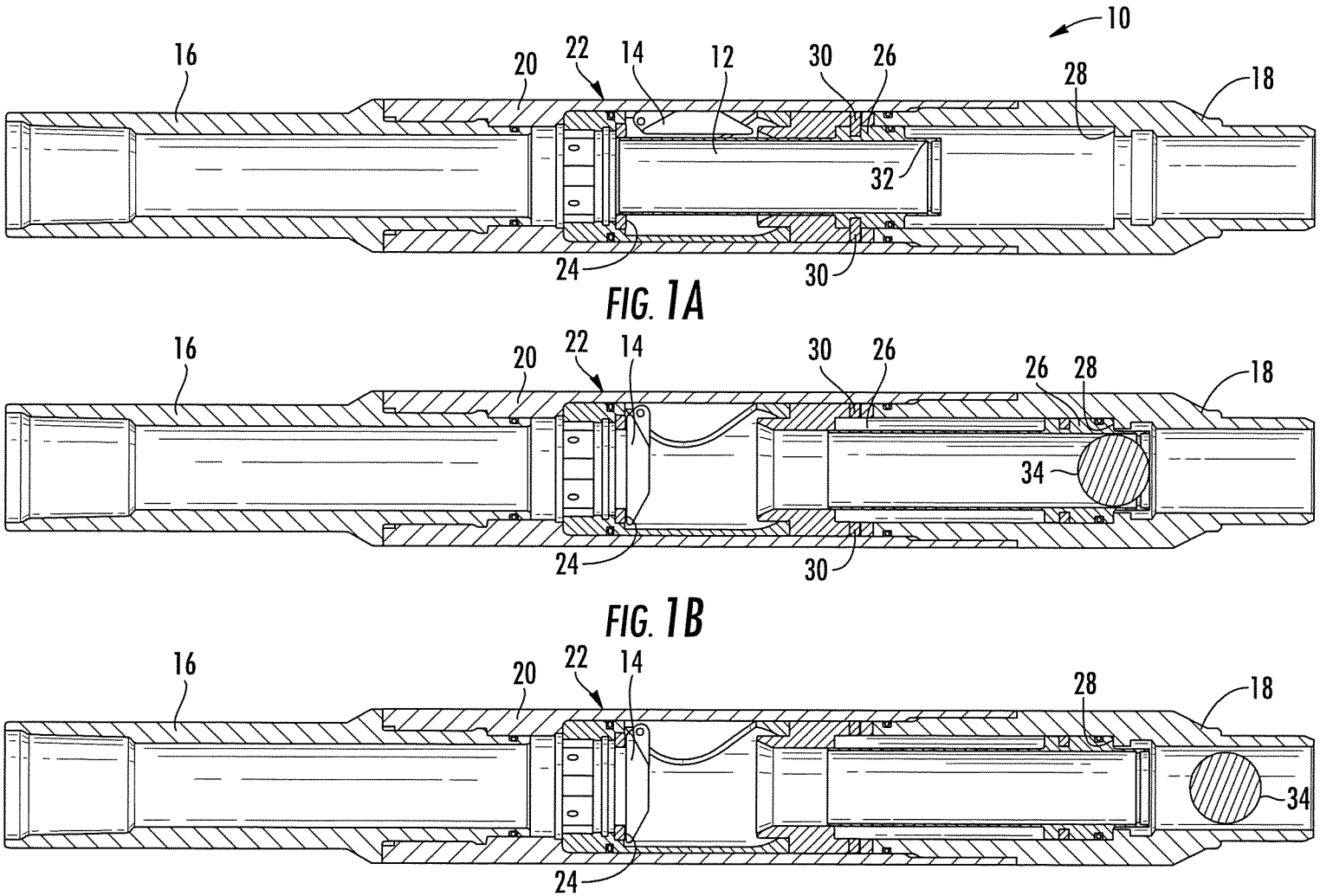
FIGS. 1A-1C are cross-sectional views of one embodiment of a downhole tool constructed in accordance with the present invention.

The present disclosure relates to a flapper valve tool 10 that can be designed and implemented into a bottom hole assembly (BHA) that has at least one sleeve disposed therein to either open a flapper 14 or permit the flapper 14 to close.

In one embodiment of the present disclosure shown in FIGS. 1A-1C, the flapper valve tool 10 includes a top sub 16 for connecting to other tools disposed above the flapper valve tool 10 in the BHA, a bottom sub 18 for connecting the flapper valve tool 10 to other tools disposed below the flapper valve tool 10 in the BHA and a housing 20 (or body) connecting the top sub 16 to the bottom sub 18. In this embodiment, the flapper valve tool 10 includes a closing sleeve 12 slidably disposed in the housing 20 and a flapper assembly 22 disposed in the housing 20.

The flapper assembly 22 includes a flapper 14 for selectively blocking the backflow of fluid through the flapper valve tool 10 and a flapper seat 24 disposed in the housing 20 such that the closing sleeve 12 can slide through the flapper seat 24. The flapper 14 sits against the flapper seat 24 when the flapper 14 is in the closed position and prevents pressurized fluid from flowing in the uphole direction through the flapper valve tool 10. The flapper 14 can be hingedly connected to the flapper seat 24 or to the inside of the housing 20.

The closing sleeve 12 shown in FIGS. 1A-1C includes a collar 26 disposed around an outside portion of the closing sleeve 12 and the flapper valve tool 10 includes a shoulder 28 disposed therein to engage the collar 26 and prevent further sliding movement of the closing sleeve 12 when the closing sleeve 12 is shifted from a first position in the flapper valve tool 10 to a second position in the flapper valve tool 10. The shoulder 28 can be disposed on the inside of the bottom sub 18 or the housing 20 of the flapper valve tool 10. The closing sleeve 12 can be held in the first position in the flapper valve tool 10 via any means known in the art, such as shear pins 30. The closing sleeve 12 can also include a lip 32 disposed around a portion of the inside of the closing sleeve 12 to create a seat for a fluid blocking member 34 to engage and not be able to pass completely through the closing sleeve 12.

FIG. 1A shows the closing sleeve 12 in its first position and holding the flapper 14 in an open position. FIG. 1B shows the fluid blocking member 34 engaged with the lip 32 of the closing sleeve 12 and the closing sleeve 12 in its second position in the flapper valve tool 10. When enough pressure is put behind the fluid blocking member 34, the shear pins 30 fail and permit the closing sleeve 12 to move from its first position to its second position in the flapper valve tool 10. The closing sleeve 12 will travel a predetermine distance before the collar 26 of the closing sleeve 12 impacts the shoulder 28 disposed on the inside of the flapper valve tool 10, which prevents further movement of the closing sleeve 12 in the flapper valve tool 10. After the closing sleeve 12 travels a specific amount, the flapper 14 is no longer prevented from closing and the flapper 14 closes against the flapper seat 24 to prevent fluid from flowing in the uphole direction through the flapper valve tool 10. If desired, high pressure fluid can be pumped down to force the fluid blocking member 34 past the lip 32 in the closing sleeve 12, as can be seen in FIG. 1C.

Figures 2A, 2B, 2C:
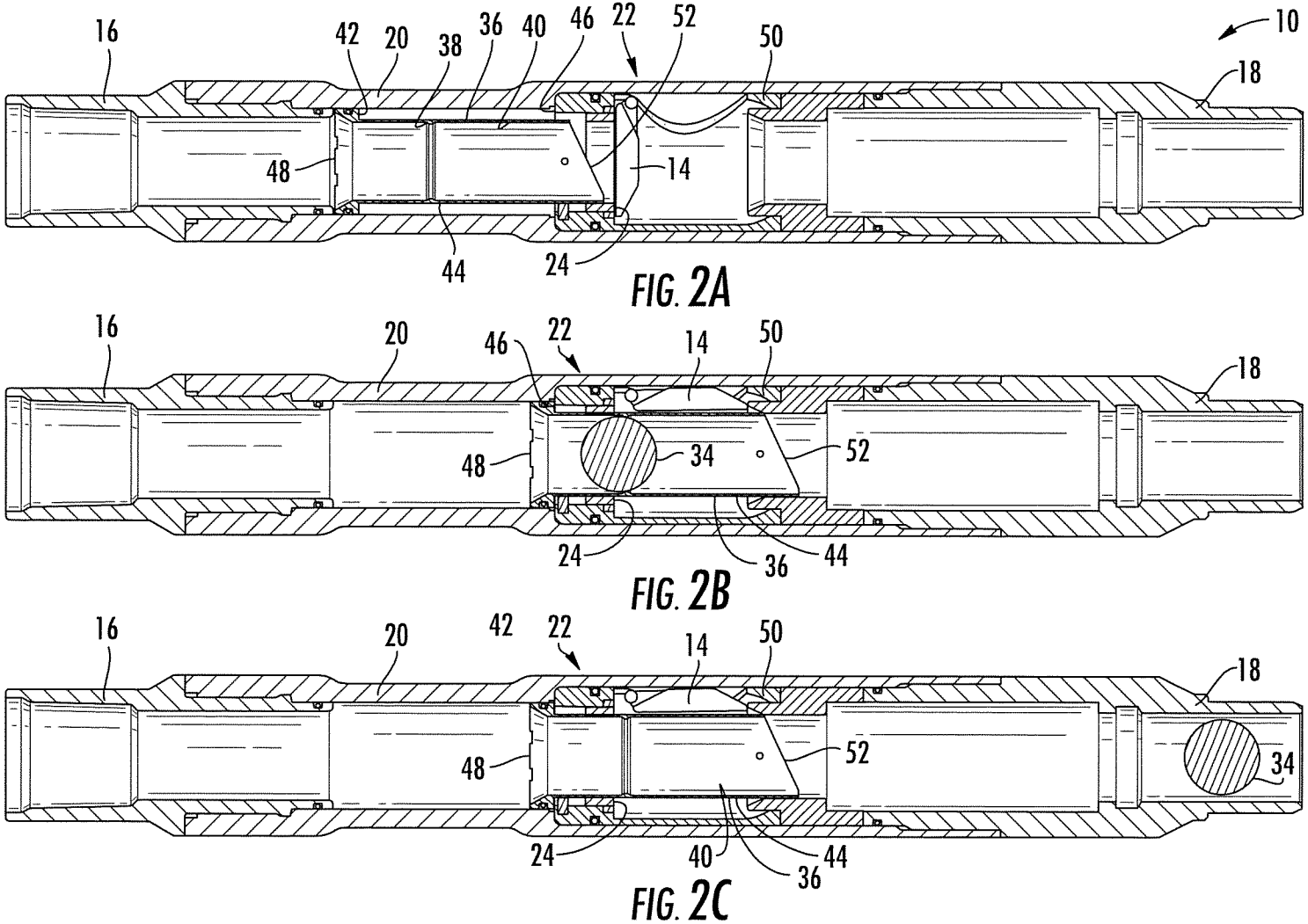
FIGS. 2A-2C are cross-sectional views of another embodiment of the downhole tool constructed in accordance with the present invention.
Figure 3:
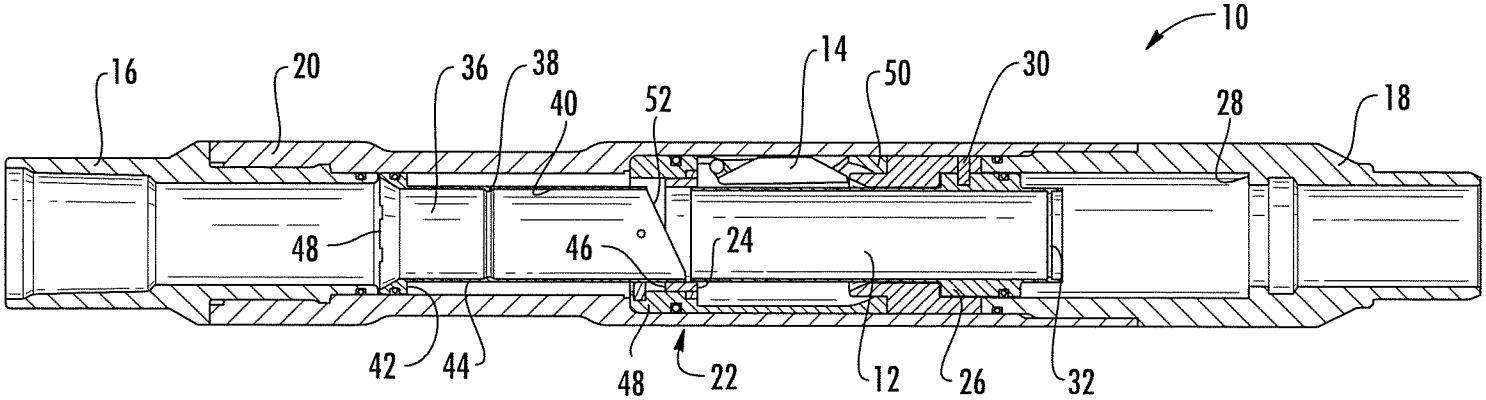
FIG. 3 is a cross-sectional view of yet another embodiment of the downhole tool constructed in accordance with the present disclosure.

In another embodiment of the present disclosure shown in FIGS. 2A-2C, the flapper valve tool 10 includes an opening sleeve 36 (as opposed to the closing sleeve 12) that has a first position where the flapper 14 is set against the flapper seat 24 (closed). Consequently, the flapper 14 is in the open position when the opening sleeve 36 is in its second position. The opening sleeve 36 has a lip 38 disposed around an inner portion 40 of the opening sleeve 36 and a collar 42 disposed around an outer portion 44 of the opening sleeve 36. The lip 38 is designed to provide a seat for engaging with the fluid blocking member 34. The collar 42 is designed to engage with a shoulder 46 disposed within the flapper valve tool 10. In one embodiment, the collar 42 is disposed on an uphole end 48 of the opening sleeve 36 to engage the shoulder 46, which can be disposed on an inner portion of the housing 20 or a part of a flapper body 50 of the flapper assembly 22. Similar to the closing sleeve 12, the opening sleeve 36 can be held in place via shear pins 30.

FIG. 2A shows the opening sleeve 36 in its first position wherein the flapper 14 is in the shut position and set against the flapper seat 24 restricting fluid from flowing in the uphole direction through the flapper valve tool 10. FIG. 2B shows the fluid blocking member 34 engaged with the lip 38 of the opening sleeve 36 and the opening sleeve 36 in its second position in the flapper valve tool 10. When enough pressure is put behind the fluid blocking member 34, the shear pins 30 fail and permit the opening sleeve 36 to move from its first position to its second position in the flapper valve tool 10. The opening sleeve 36 will travel a predetermined distance before the collar 42 of the opening sleeve 36 impacts the shoulder 46 disposed on the inside of the flapper valve tool 10, which prevents further movement of the opening sleeve 36 in the flapper valve tool 10.

After the flapper valve tool 10 travels a specific amount, a downhole end 52 of the opening sleeve 36 contacts the flapper 14 and forces the flapper 14 into the open position as the opening sleeve 36 moves into its second position. This allows fluid to now flow in the uphole direction through the flapper valve tool 10. If desired, high pressure fluid can be pumped down to force the fluid blocking member 34 past the lip 38 in the opening sleeve 36 as can be seen in FIG. 2C.

The fluid blocking member 34 can be pumped out of the flapper valve tool 10 and into some type of collection area so that fluid is permitted to flow in the uphole direction in the flapper valve tool 10. In a further embodiment, the downhole end 52 of the opening sleeve 36 can be angled such that opening the flapper 14 is significantly easier. The angle in the downhole end 52 of the opening sleeve 36 is designed such that the longer portion of the opening sleeve 36 contacts the flapper 14 on the opposite side of the flapper 14 from where the flapper 14 is hinged.

Figure 4A:
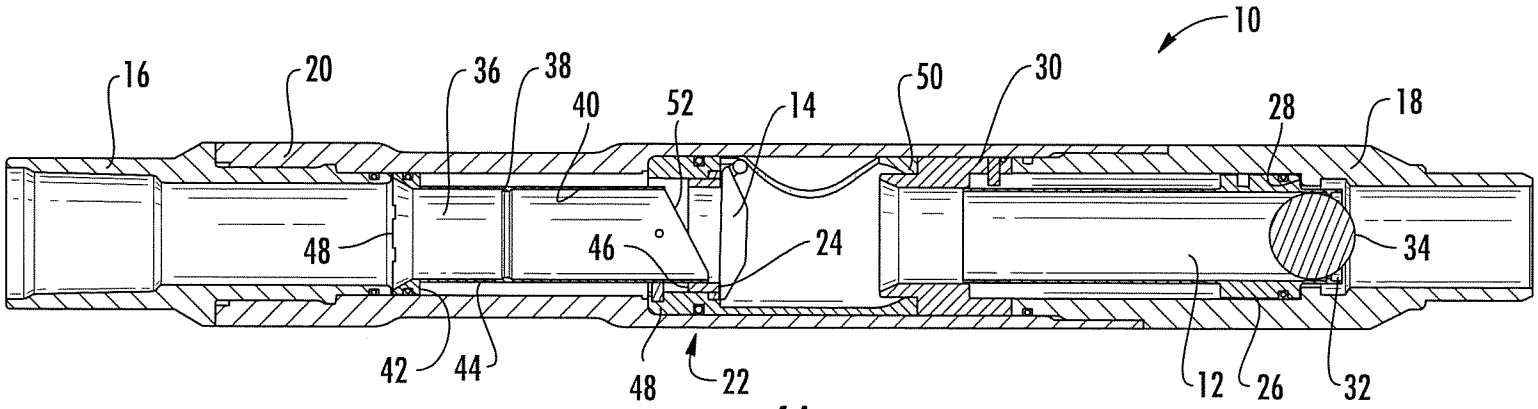
FIGS. 4A and 4B are cross-sectional views of the embodiment of the downhole tool shown in FIG. 3 in a second position and constructed in accordance with the present disclosure.
Figure 4B:
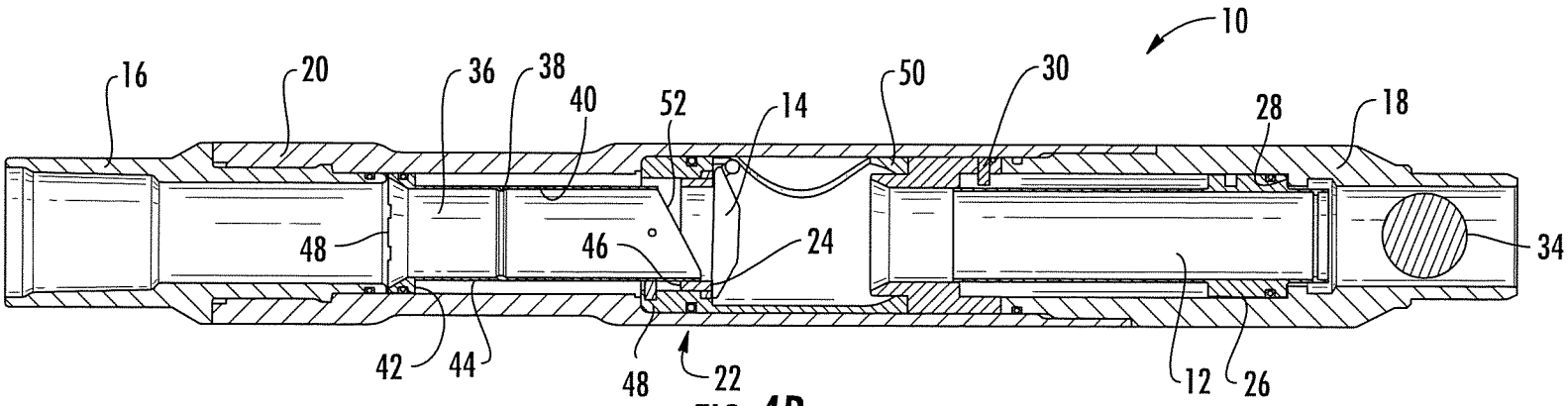
Figure 5A:
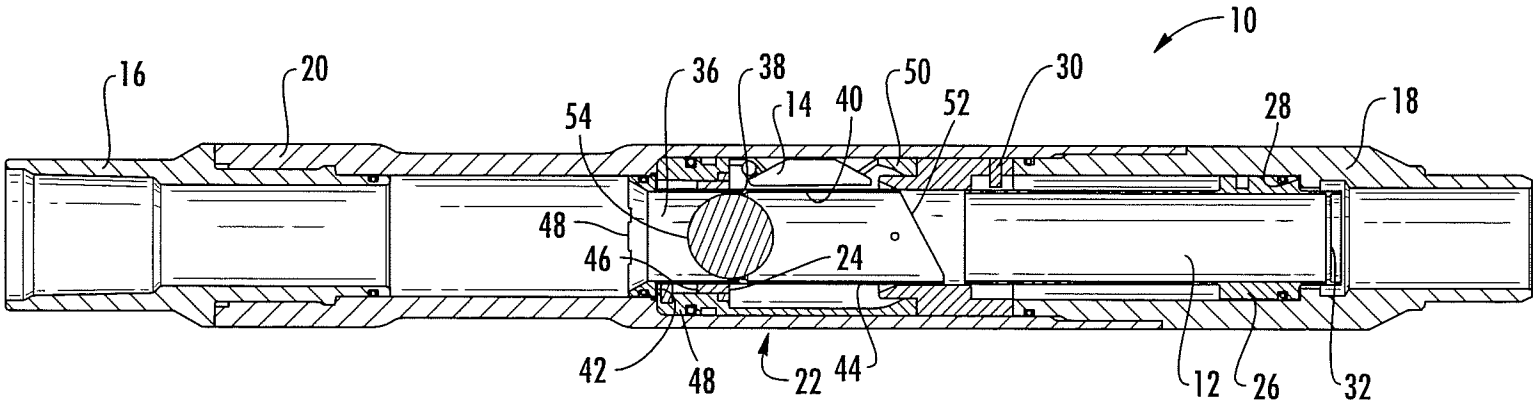
FIGS. 5A and 5B are cross-sectional views of the embodiment of the downhole tool shown in FIG. 3 in a third position and constructed in accordance with the present disclosure.
Figure 5B:
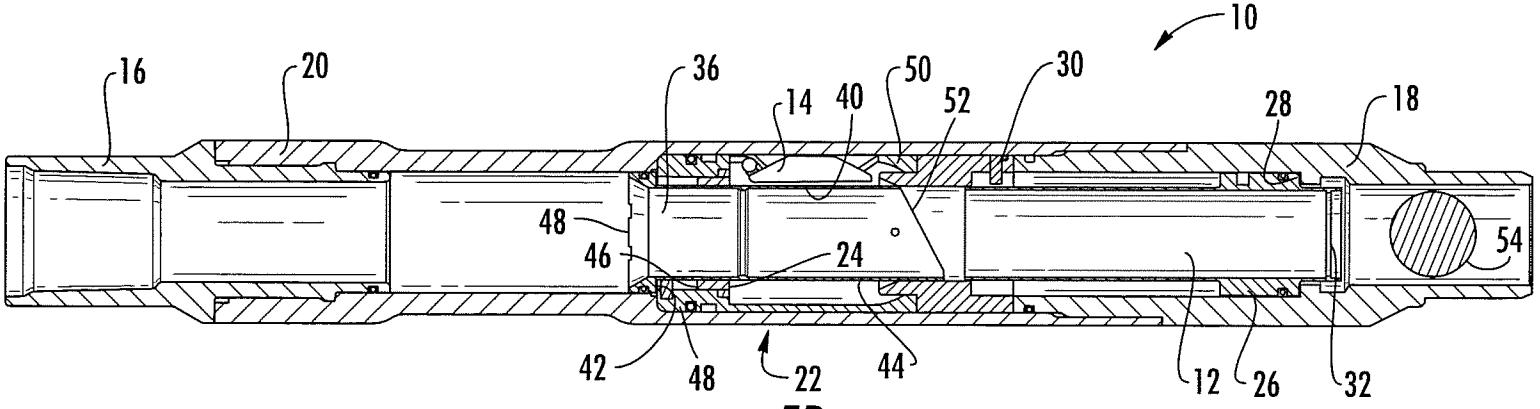

In yet another embodiment of the present disclosure shown in FIGS. 3-5B, the flapper valve tool 10 can be designed such that it has a first position where the flapper 14 is in an open position (see FIG. 3), a second position where the flapper 14 is in a closed position (see FIGS. 4A and 4B) and a third position where the flapper 14 is back in the open position (see FIGS. 5A and 5B). The flapper valve tool 10 includes the top sub 16, the bottom sub 18 and the housing 20, as previously described herein. The flapper valve tool 10 also includes the flapper assembly 22, the closing sleeve 12, and the opening sleeve 36, as described herein. The closing sleeve 12 is positioned downhole of the opening sleeve 36 in the flapper valve tool 10. Furthermore, the flapper assembly 22 can include the flapper 14, the flapper seat 24 and the flapper body 50, as previously described herein.

In use, the fluid blocking member 34 is pumped into the flapper valve tool 10 to contact the lip 32 in the closing sleeve 12. Fluid is pressured up behind the fluid blocking member 34 to shear pins 30 holding the closing sleeve 12 in the first position, which holds the flapper 14 in the open position. Once the shear pins 30 are sheared, the closing sleeve 12 is forced in the downhole direction inside the flapper valve tool 10 and into a second position for the closing sleeve 12, as shown in FIGS. 4A and 4B. After the closing sleeve 12 travels a predetermined length inside the flapper valve tool 10, the flapper 14 will spring shut against the flapper seat 24. Once the closing sleeve 12 is in the second position, fluid in the system can be further pressured up and the fluid blocking member 34 can be forced past the lip 32 disposed in the closing sleeve 12 and out of the flapper valve tool 10. FIG. 4B shows the closing sleeve 12 in the second position after the fluid blocking member 34 is pushed out of the closing sleeve 12 of the flapper valve tool 10 and the opening sleeve 36 in its first position. It should be understood and appreciated that the fluid blocking member 34 is sized such that it can pass by the lip 38 in the opening sleeve 36 and then engage the lip 32 in the closing sleeve 12.

When it is desirous to have the flapper 14 back in the open position, a second fluid blocking member 54 can be pumped down into the flapper valve tool 10. The second fluid blocking member 54 is pumped down and contacts the lip 38 in the opening sleeve 36. The fluid in the flapper valve tool 10 is pressured up and shear pins 30 holding the opening sleeve 36 in the opening sleeve's 36 first position are sheared, allowing the opening sleeve 36 to move in the downhole direction in the flapper valve tool 10. As the opening sleeve 36 moves in the downhole direction, the opening sleeve 36 contacts the flapper 14 and forces it open. When the opening sleeve 36 reaches its second position in the flapper valve tool 10, the opening sleeve 36 prevents the flapper 14 from closing and maintains the flapper 14 in the open position, which is shown in FIG. 5.

Once the opening sleeve 36 is in its second position, fluid in the system can be further pressured up and the second fluid blocking member 54 can be forced past the lip 38 disposed on the opening sleeve 36 and out of the flapper valve tool 10. FIG. 5B shows the closing sleeve 12 in its second position and the opening sleeve 36 in its second position after the second fluid blocking member 54 was pushed out of the flapper valve tool 10.

The present disclosure is also directed toward a method of controlling the flapper valve tool 10 and the backflow of fluid from the BHA into any tubing or tubing string the BHA is attached to. The method can include placing the flapper valve tool 10 into a wellbore, activating the closing sleeve 12 or the opening sleeve 36 to close or open the flapper 14, respectively. Activation of the closing sleeve 12 or the opening sleeve 36 can be accomplished by pumping the fluid blocking members 34, 54 into the flapper valve tool 10 to engage the lips 32, 38 of the sleeves 12, 36.

In another embodiment of the present disclosure, the flapper valve tool 10 is placed in the wellbore and the closing sleeve 12 is shifted from its first position to its second position, which causes the flapper 14 to transition from an open position to a closed position. The opening sleeve 36 can then be shifted from its first position to its second position, which causes the flapper 14 to transition from the closed position back to the open position.

In further embodiments of the present disclosure, the flapper valve tool 10 can include a deformable element that assists in the prevention of movement of the closing sleeve 12 and/or the opening sleeve 36 when they are in their second positions, respectively. The deformable elements can also contribute to maintaining the flappers 14 in the open position. The deformable element can be disposed on the closing sleeve 12 and/or the opening sleeve 36, the flapper 14 (flapper assembly 22) and/or other parts of the flapper valve tool 10. It should be understood and appreciated that any flapper valve tool described herein can include a deformable element.

Figure 6A:
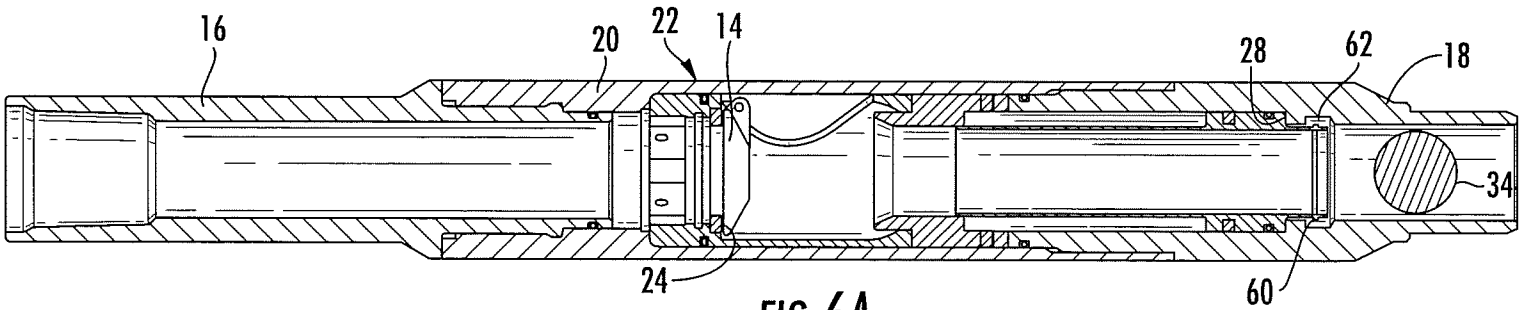
FIG. 6A is a cross-sectional view of another embodiment of the downhole tool shown in FIGS. 1A-1C constructed in accordance with the present invention.

In one embodiment shown in FIGS. 6A-6E, the lips 32 and 38 disposed on the closing sleeve 12 and the opening sleeve 36 are deformable. FIG. 6A shows the result of the flapper valve tool 10 shown in FIG. 1B after the fluid blocking member 34 is forced past the lip 32. A deformed portion 60 is created in the closing sleeve 12 due to the force and pressure required to force the fluid blocking member 34 past the lip 32 in the closing sleeve 12. The deformed portion 60 of the closing sleeve 12 extends into a depression area 62 disposed on the inner portion of the housing 20 or bottom sub 18 and prevents the closing sleeve 12 from traveling in the uphole direction in the flapper valve tool 10.

Figure 6B:
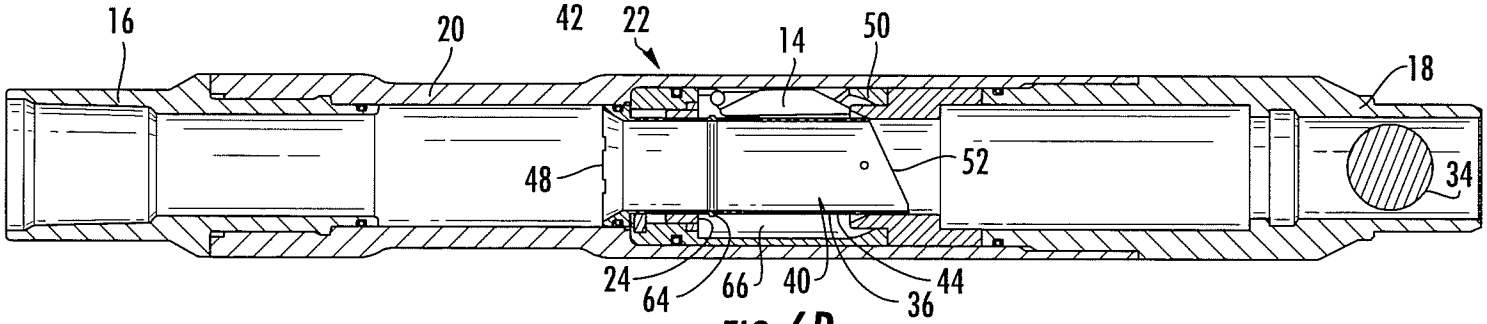
FIG. 6B is a cross-sectional view of another embodiment of the downhole tool shown in FIGS. 2A-2C constructed in accordance with the present invention.

FIG. 6B shows the result of the flapper valve tool 10 shown in FIG. 2B after the fluid blocking member 34 is forced past the lip 38, a deformed portion 64 is created in the opening sleeve 36 due to the force and pressure required to force the fluid blocking member 34 past the lip 38 in the opening sleeve 36. The deformed portion 64 of the opening sleeve 36 extends into a depression area 66 disposed on the inner portion of the housing 20 and adjacent to the flapper seat 24. The deformed portion 64 being wider than the flapper valve seat 24 prevents the opening sleeve 36 from traveling in the uphole direction in the flapper valve tool 10.

Figure 6C:
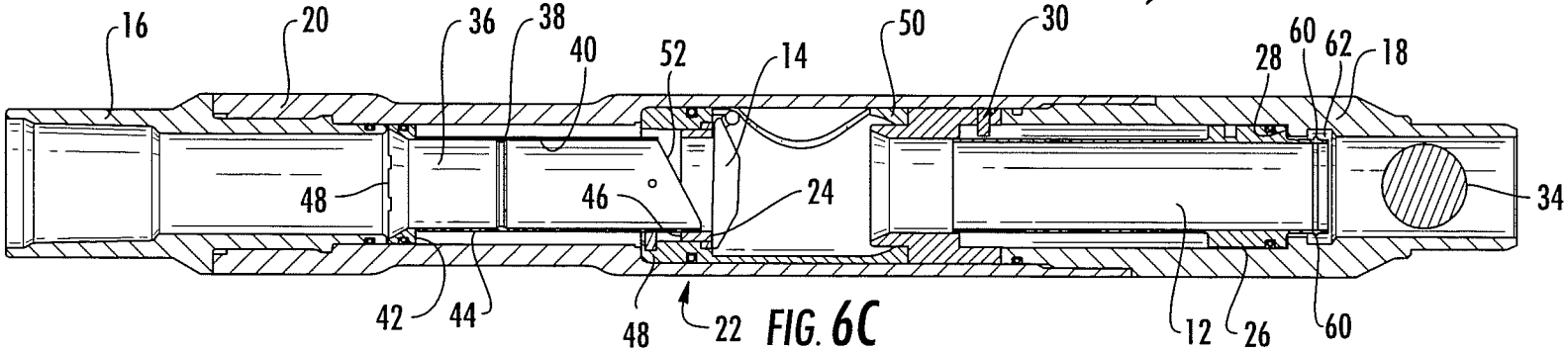
FIGS. 6C-6E are cross-sectional views of another embodiment of the downhole tool shown in FIGS. 3-5B constructed in accordance with the present invention.

FIG. 6C shows the result of the flapper valve tool 10 shown in FIG. 4B after the fluid blocking member 34 is forced past the lip 32, the deformed portion 60 is created in the closing sleeve 12 due to the force and pressure required to force the fluid blocking member 34 past the lip 32 in the closing sleeve 12. The deformed portion 60 of the closing sleeve 12 extends into the depression area 62 disposed on the inner portion of the housing 20 or bottom sub 18 and prevents the closing sleeve 12 from traveling in the uphole direction in the flapper valve tool 10.

Figure 6D:
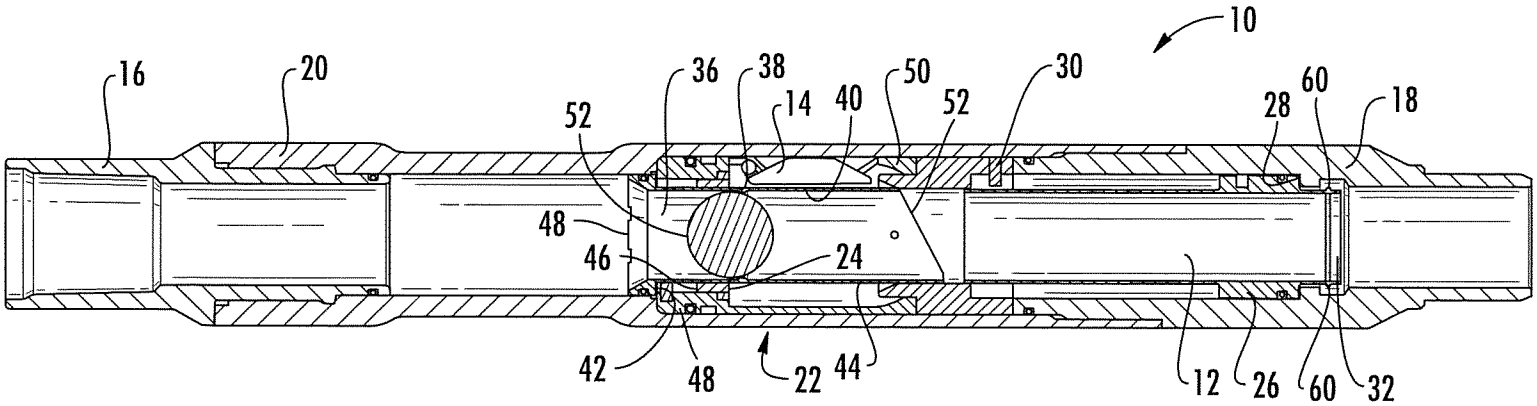
Figure 6E:
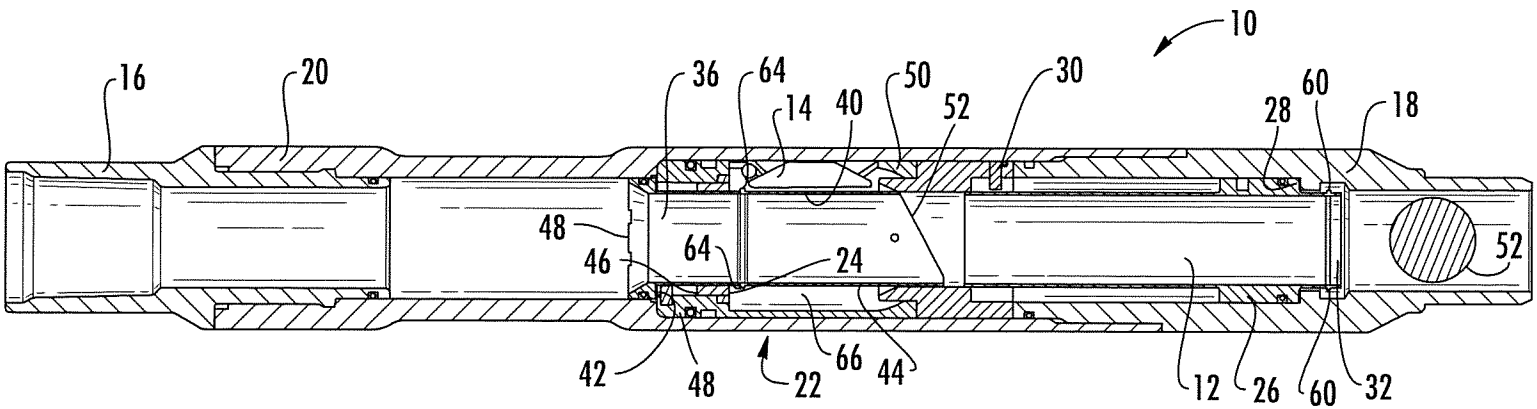
Figure 7A:
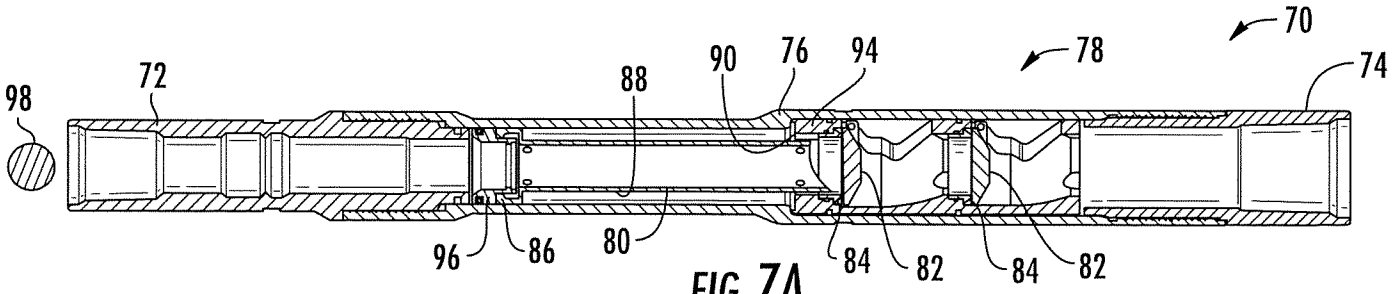
FIGS. 7A-7C are cross-sectional views of another embodiment of the downhole tool constructed in accordance with the present invention.
Figure 7B:
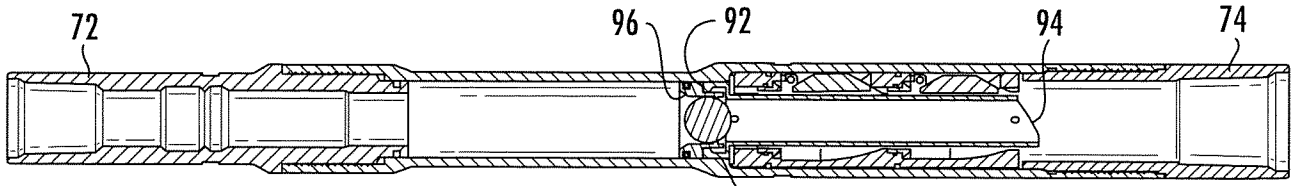
Figure 7C:
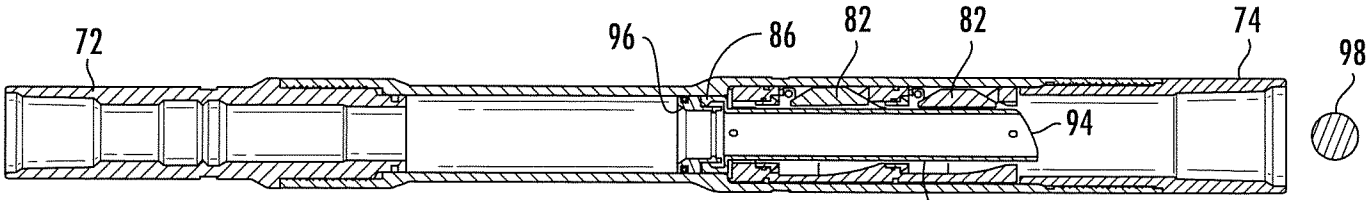

FIGS. 6D and 6E show the result of the flapper valve tool 10 shown in FIGS. 5A and 5B before and after the fluid blocking member 54 is forced past the lip 38, the deformed portion 64 is created in the opening sleeve 36 due to the force and pressure required to force the fluid blocking member 54 past the lip 38 in the opening sleeve 36. The deformed portion 64 of the opening sleeve 36 extends into the depression area 66 disposed on the inner portion of the housing 20 and adjacent to the flapper seat 24. The deformed portion 64 being wider than the flapper valve seat 24 prevents the opening sleeve 36 from traveling in the uphole direction in the flapper valve tool 10.

Referring now to FIGS. 7A-10, shown therein are new embodiments of a flapper valve tool 70. Shown in more detail in FIGS. 7A-7C, the flapper valve tool 70 includes a top sub 72 for connection to tools disposed above the flapper valve tool 70, a bottom sub 74 for attachment of the flapper valve tool 70 to tools disposed below the flapper valve tool 70, and a housing 76 disposed between the top sub 72 and the bottom sub 74. The flapper valve tool 70 further includes a flapper assembly 78 and a sleeve 80 slidably disposed within the housing 76.

The flapper assembly 78 includes at least one flapper 82 (multiple flappers 82 can be implemented) for selectively blocking the backflow of fluid through the flapper valve tool 70 and a flapper seat 84 for each flapper 82 disposed in the housing 76 such that the sleeve 80 can slide through the flapper seat(s) 84. The flapper 82 sits against the flapper seat 84 when the flapper 82 is in the closed position and prevents pressurized fluid from flowing in the uphole direction through the flapper valve tool 70. The flapper 82 can be hingedly connected to the flapper seat 84 or to the inside of the housing 76.

The sleeve 80 has a first position where the flapper 82 is set against the flapper seat 84 (closed). Consequently, the flapper 82 is in the open position when the sleeve 80 is in its second position. The sleeve 80 has a collar 86 disposed around an outer portion 88 of the sleeve 80. The collar 86 is designed to engage with a shoulder 90 disposed within the flapper valve tool 70. In one embodiment, the collar 86 is disposed on an uphole end 92 of the sleeve 80 to engage the shoulder 90, which can be disposed on an inner portion of the housing 76 or a part of a flapper body 94 of the flapper assembly 78. The sleeve 80 includes a downhole end 94 that can be angled to more efficiently engage and open the flapper 82.

The flapper valve tool 70 also includes a seat 96 engagable with the uphole end 92 of the sleeve 80. In one embodiment, the seat 96 is constructed of an extrudable material and be dissolvable in a dissolving solution. The dissolving solution can include an acidic component. The seat 96 can be designed such that a fluid blocking member 98 can be pumped into the flapper valve tool 70 and engage the seat 96 and prevent fluid from flowing through the flapper valve tool 70. The pressure of the fluid in the flapper valve tool 70 can be increased such that the engagement of the fluid blocking member 98 and the seat 96 causes the sleeve 80 to be shifted in the downhole direction in the flapper valve tool 70.

Figure 8A:
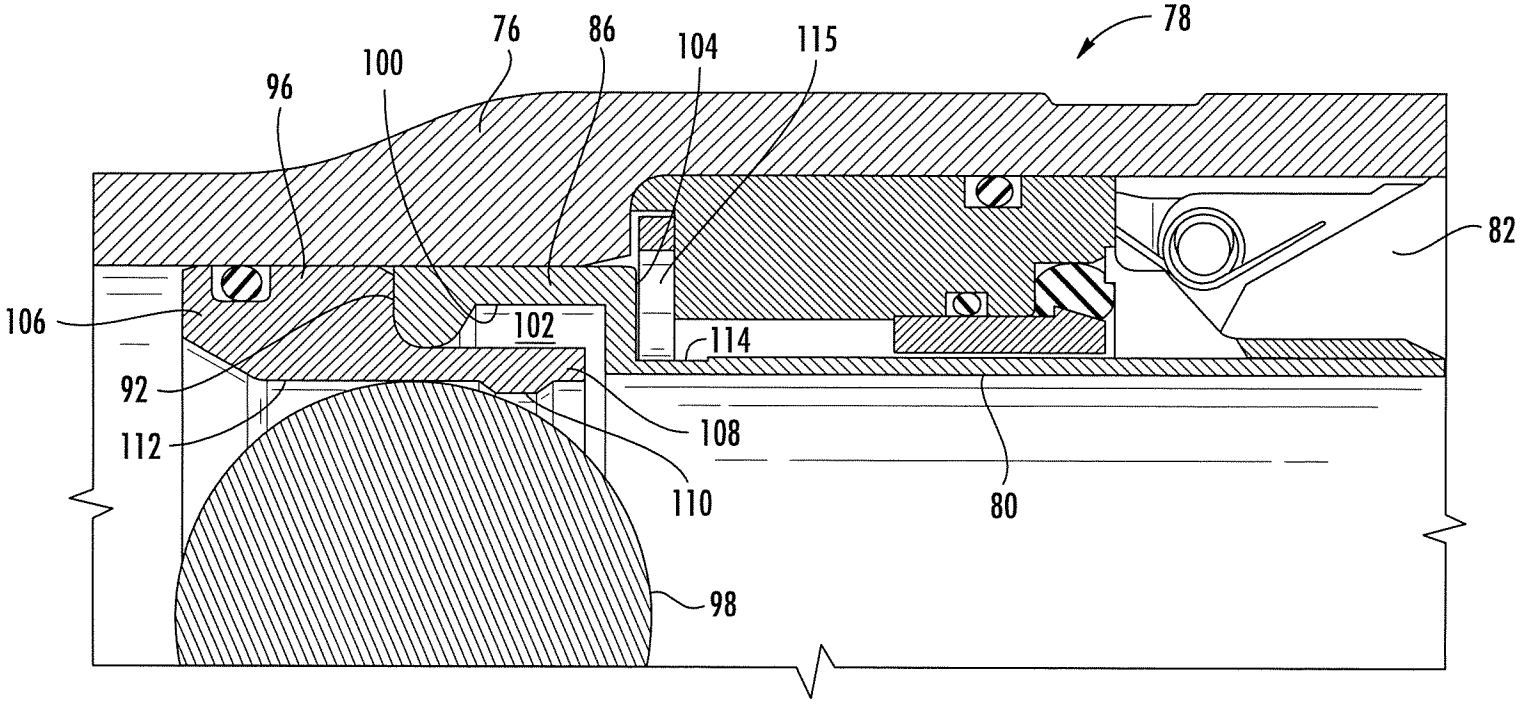
FIGS. 8A and 8B are close-up, cross-sectional views of a portion of the downhole tool shown in FIGS. 7A-7C and constructed in accordance with the present invention.
Figure 8B:
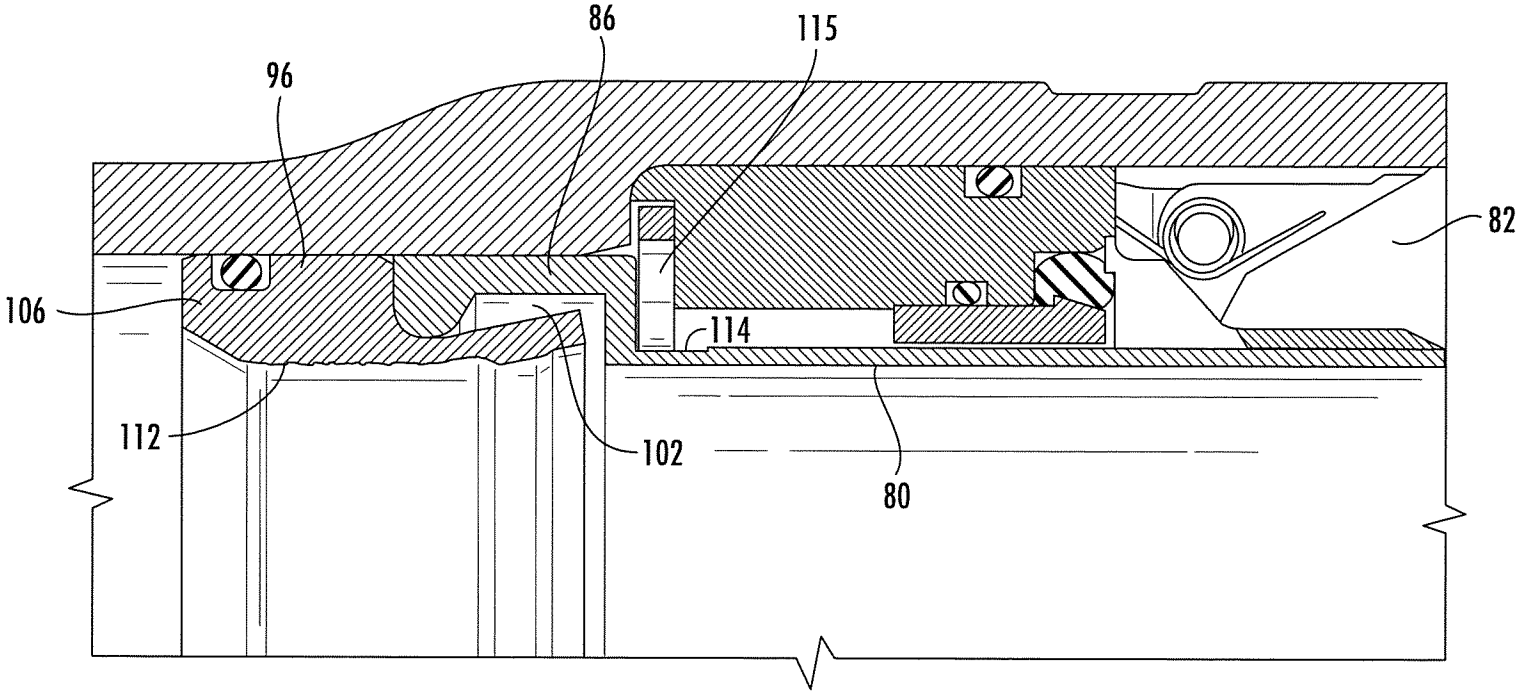

Shown in more detail in FIGS. 8A and 8B, the design of the seat 96 and the uphole end 92 of the sleeve 80 permits the fluid blocking member 98 to be passed through the flapper valve tool 70 when the pressure of the fluid is pressured up to a predetermined threshold. The collar 86 of the sleeve 80 includes a recessed portion 100 on an internal part 102 of the collar 86. Furthermore, the collar 86 includes a shoulder portion 104 that defines the downhole end of the collar 86. The seat 96 can have a main body 106 positioned adjacent to the uphole end 92 of the sleeve 80 and a sleeve element 108 extending from the main body 106 and into the collar 86 such that the sleeve element 108 is positioned adjacent to the internal part of the collar 86. Furthermore, the seat 96 includes a lip 110 disposed on an inner surface 112 of the sleeve element 108.

In use, the fluid blocking member 98 is pumped down into the flapper valve tool 70 where it contacts the lip 110 of the seat 96. Pressure of fluid is increased in the flapper valve tool 70 and the fluid blocking member 98 forces the seat 96 and the sleeve 80 to slide in the downhole direction in the flapper valve tool 70. The pressure of the fluid in the flapper valve tool 70 can be increased even further wherein the fluid blocking member 98 is forced past the seat 96 and out of the flapper valve tool 70. In this embodiment, the seat 96 is deformable and the sleeve element 108 can be flexed radially outward into the recessed portion 100 of the collar 86. A dissolving solution can then be passed through the flapper valve tool 70 to dissolve at least a portion of the seat 96 to widen the passageway through the seat 96 (see FIG. 8B).

In a further embodiment of the present disclosure, the sleeve 80 includes a recessed area 114 disposed adjacent to the shoulder 104 of the collar 86. The recessed area 114 engages a snap ring 115 which is statically disposed within the flapper valve tool 70. When the sleeve 80 is shifted a certain amount in the flapper valve tool 70 in the downhole direction, the snap ring 115 engages the recessed area 114 to prevent the sleeve 80 from shifting back in the uphole direction. In another embodiment, the snap ring 115 can be disposed adjacent to the flapper assembly 78.

In another embodiment of the present disclosure shown in FIGS. 9A-9D, the flapper valve tool 70 includes a secondary flapper apparatus 116 disposed at least partially within the flapper valve tool 70. The secondary flapper apparatus 116 can include at least one secondary flapper 118 disposed therein to prevent fluid from flowing in the uphole direction through the flapper valve tool 70 when not desired. The secondary flapper apparatus 116 can have a flapper housing 120 and a sleeve 122 extending therefrom in the uphole direction such that the sleeve 120 maintains the flappers 82 in an open position. The sleeve 122 and the secondary flappers 118 allow fluid to flow through the flapper valve tool 70 in the downhole direction. The secondary flapper apparatus 116 can be held in place in the housing 76 via shear pins 124.

The sleeve 122 can have a propped end 126 that engages with at least one propped ball 128 disposed in an uphole end 130 of the flapper housing 120 to force the propped ball (s) 128 into a depression area 131 disposed on the inside of the housing 76 and a seat 132 disposed in an uphole end 134 of the sleeve 122. The sleeve 122 can also include a body 136 for engaging with the inside of the housing 76 and stabilizing the secondary flapper apparatus 116 in the housing 76 and a recessed area 138 disposed on the sleeve 122 between the body 136 and the propped end 126. The secondary flapper apparatus 116 can be configured to have a bottom sub portion so that the flapper valve tool 70 in this embodiment can be attached to other downhole tools downhole of the flapper valve tool 70.

Figures 9A, 9B, 9C, 9D:
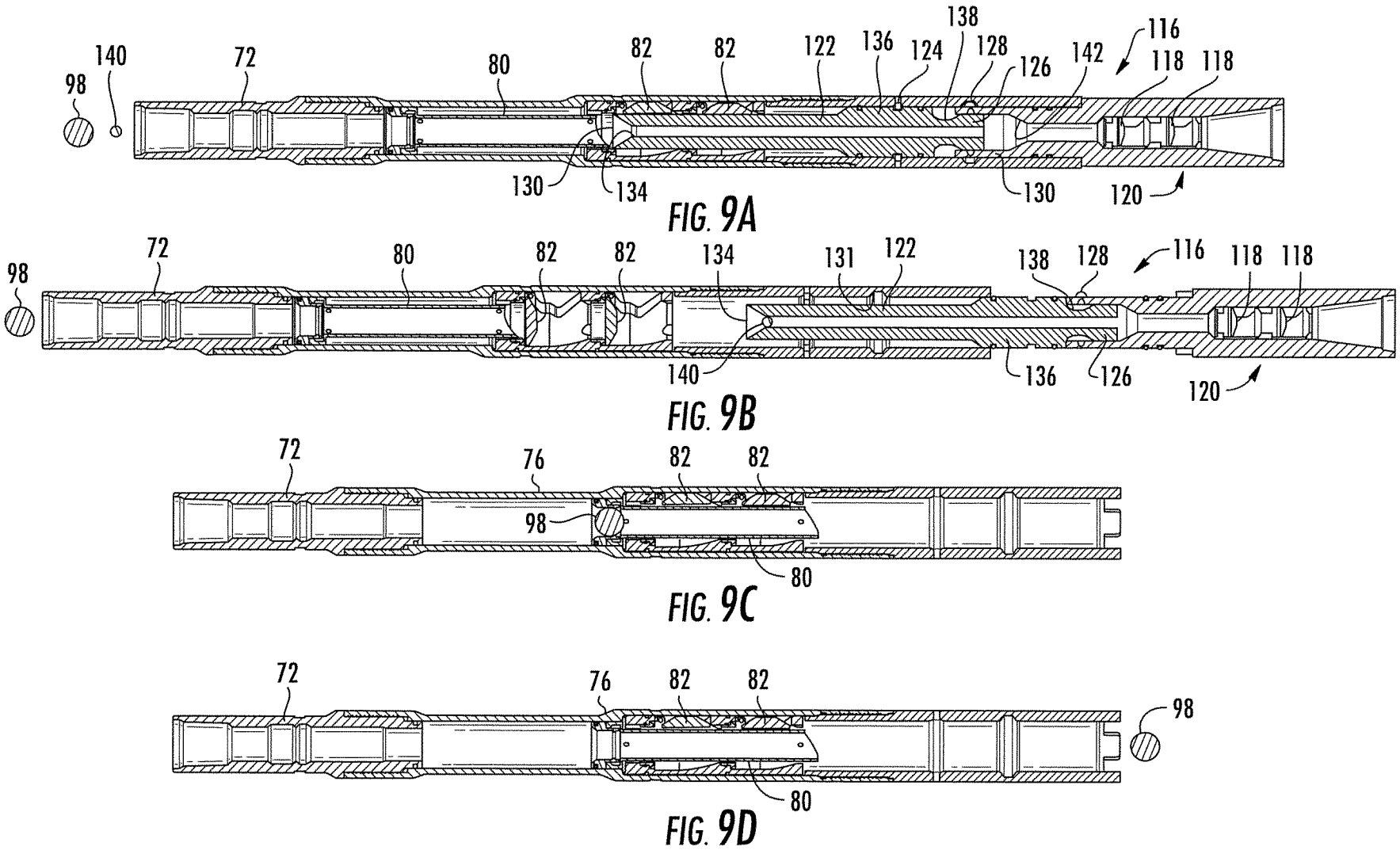
FIGS. 9A-9D are cross-sectional views of another embodiment of the downhole tool constructed in accordance with the present invention.

In use, the flapper valve tool 70 can be used in a bottom hole assembly (BHA) and the BHA can be positioned adjacent to a terminal location in a horizontal well. As can be seen in FIG. 9B, a fluid blocking member 140 can then be pumped down into the flapper valve tool 70, passed through the sleeve 80 and contacted the seat 132 and prevent fluid from passing through the secondary flapper apparatus 116. Pressure of the fluid in the flapper valve tool 70 can then be pressured to a specific pressure threshold wherein the shear pins 124 shear and allow the sleeve 122 to slide in the downhole direction in the flapper valve tool 70. The sliding of the sleeve 122 causes the propped end 126 to slide in the flapper valve tool 70 and cease contact with the propped ball 128 allowing the propped ball 128 to disengage with the sleeve 122 and settle in an area adjacent to the recessed area 138.

The propped end 126 of the sleeve 122 can then be forced to then end of a cavity area 142 disposed in the body 136 of the secondary flapper apparatus 116 wherein the secondary flapper apparatus 116 is then forced out of the flapper valve tool 70. This permits the flappers 82 to close and prevent fluid from passing in the uphole direction through the flapper valve tool 70. Once the secondary flapper apparatus 116 is forced out of the flapper valve tool 70, the flapper valve tool 70 is then positioned at a desired location in the wellbore (e.g. at the heel). The fluid blocking member 98 can then be pumped down into the flapper valve tool 70 to shift the sleeve 80 as previously described herein.

In a further embodiment of the present disclosure, the fluid blocking members 34, 52, 98, 140 can be constructed of a material that is dissolvable in specific types of fluid and/or well bore fluids. Thus, after the fluid blocking members 34, 52, 98, or 140 are pumped through the sleeves 12, 36, 80 or 122, a solution capable of dissolving the fluid blocking members 34, 52, 98, 140 is pumped through the flapper valve tool 70 to dissolve the fluid blocking members 34, 52, 98, 140 so that the fluid blocking members 34, 52, 98, 140 will not hinder production of fluids (oil or gas) from the well. It should be understood that the fluid blocking members 34, 52, 98, 140 can be dissolved in the dissolving solution described above. The dissolving solution can be different for the fluid blocking members 34, 52, 98, 140 or it can be the same. The dissolving solution can include an acidic solution.

Figures 10A, 10B, 10C:
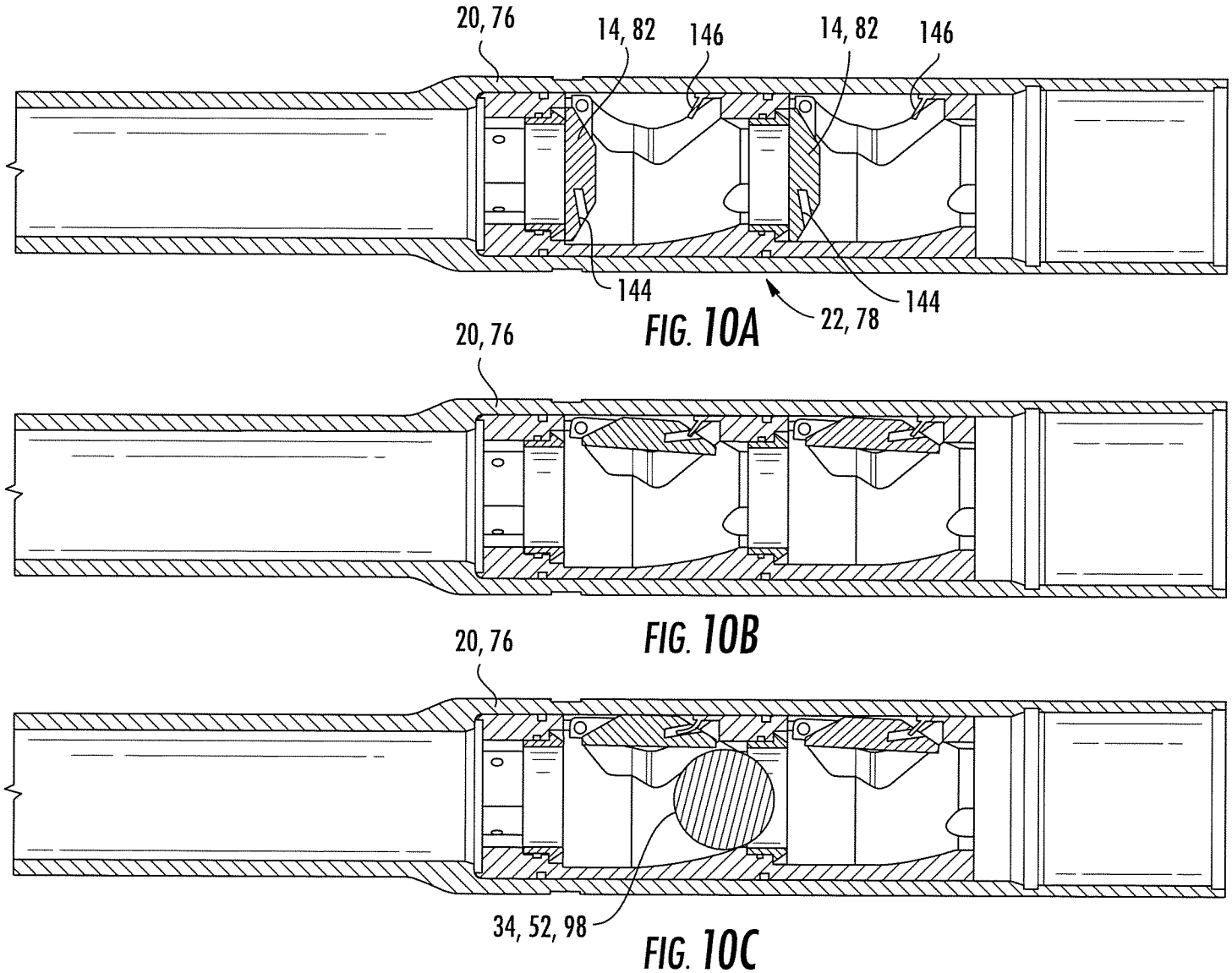
FIGS. 10A-10C are cross-sectional views of another embodiment of a portion of the downhole tool constructed in accordance with the present invention.

In an even further embodiment of the present disclosure shown in FIGS. 10A-10C, the flappers 14, 82 can include an opening 144 disposed therein to engage with a deformable pin element 146 extending from the flapper assembly 22, 78. In use, fluid can be passed through the flapper valve tool 10, 70 and the opening 144 in the flappers 14, 82 do not forcibly engage with the deformable pin element 146 of the flapper assembly 22, 78. In this embodiment, when the last fluid blocking member 34, 52, 98 is passed through the flapper assembly 22, 78 it forces the flapper open further and more forcibly. This more forcible opening causes the deformable pin element 146 to be deformed and forced into the opening 144. The deformation of the deformable pin element 146 causes the deformable pin element 146 to remain in the opening 144, which causes the flappers 14, 82 to remain open.

Figure 11A:
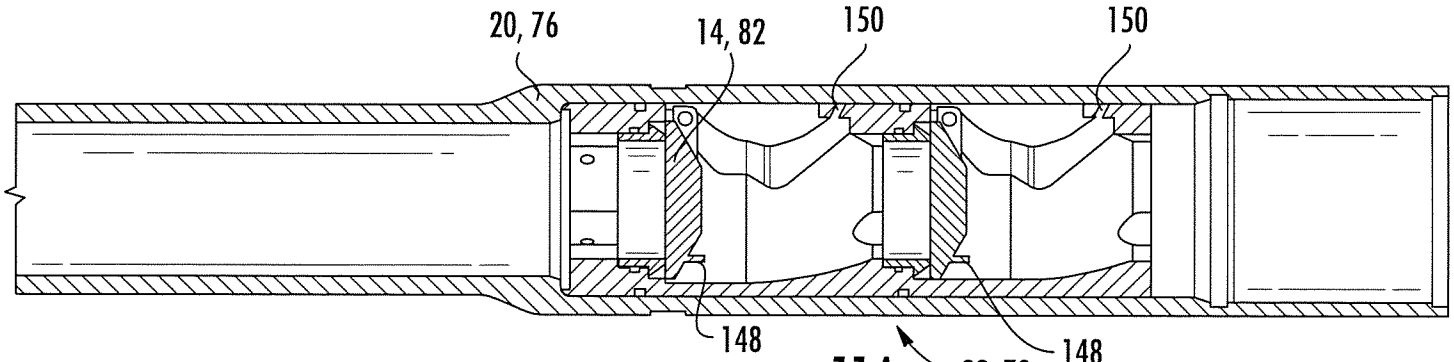
FIGS. 11A-11C are cross-sectional views of another embodiment of a portion of the downhole tool constructed in accordance with the present invention.
Figure 11B:
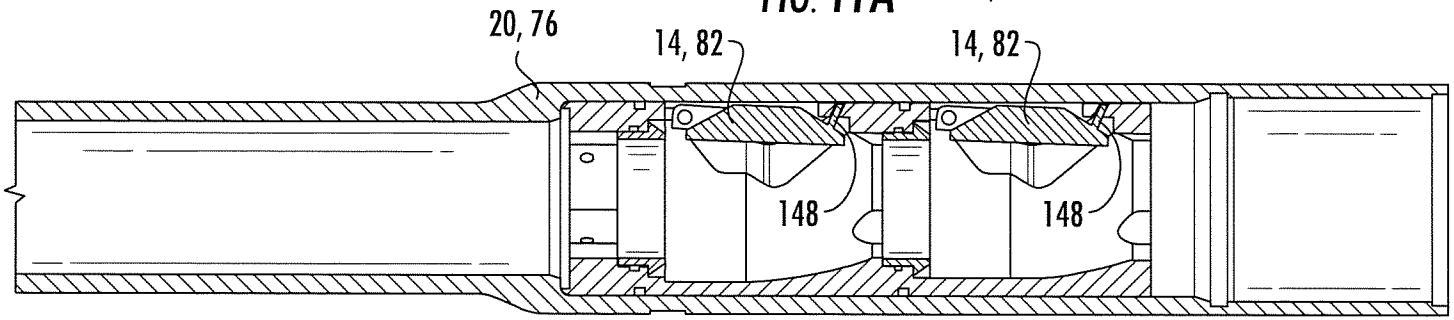
Figure 11C:
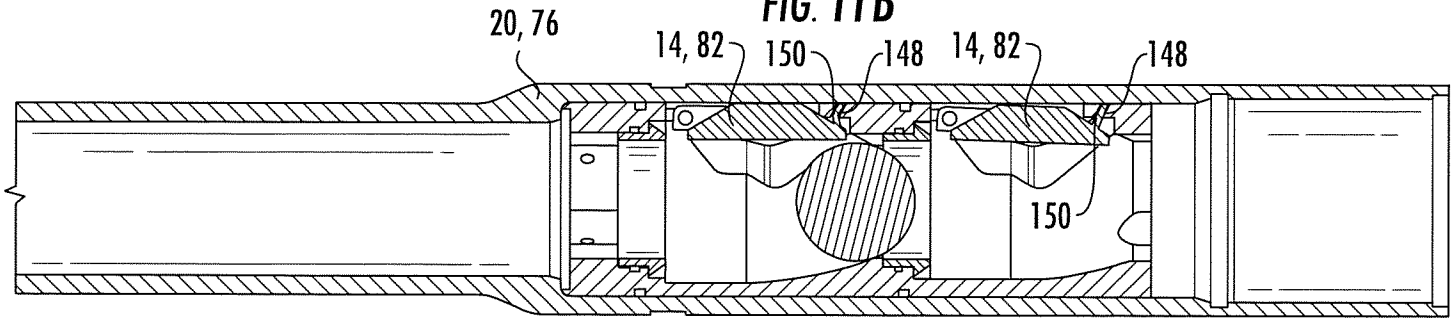

In an even further embodiment of the present disclosure shown in FIGS. 11A-11C, the flappers 14, 82 can include a deformable pin element 148 disposed thereon to engage with an opening 150 disposed in a portion of the flapper assembly 22, 78. In use, fluid can be passed through the flapper valve tool 10, 70 and the deformable pin element 148 on the flappers 14, 82 do not forcibly engage with the opening 150 disposed in the flapper assembly 22, 78. In this embodiment, when the last fluid blocking member 34, 52, 98 is passed through the flapper assembly 22, 78 it forces the flapper open further and more forcibly. This more forcible opening causes the deformable pin element 148 to be deformed and forced into the opening 150. The deformation of the deformable pin element 148 causes the deformable pin element 148 to remain in the opening 150, which causes the flappers 14, 82 to remain open.

From the above description, it is clear that the present disclosure is well adapted to carry out the objectives and to attain the advantages mentioned herein as well as those inherent in the disclosure. While presently disclosed embodiments have been described for purposes of this disclosure, it will be understood that numerous changes may be made which will readily suggest themselves to those skilled in the art and which are accomplished within the spirit of the disclosure.

What is claimed is:

1. A downhole tool, the tool comprising:

a flapper valve assembly for controlling the backflow of fluid into a tubing string, the flapper valve assembly includes at least one flapper;

a primary sleeve slidably disposed within at least a portion of the flapper valve assembly and the downhole tool;

a deformable seat disposed on an uphole end of the primary sleeve, the deformable seat having a secondary sleeve extending therefrom at least partially inside of the primary sleeve, the secondary sleeve flexes outward in a radial direction relative to the primary sleeve when a fluid blocking member is passed by the deformable seat; and a dissolvable fluid blocking member to engage with the seat to shift the primary sleeve from first position to a second position within the downhole tool, the dissolvable fluid blocking member dissolvable in a first dissolving solution.

2. The tool of claim 1 wherein the deformable seat is dissolvable in a second dissolving solution.

3. The tool of claim 2 wherein the first dissolving solution and the second dissolving solution are the same solution.

4. The tool of claim 3 wherein the dissolving solution includes an acidic component.

5. The tool of claim 1 wherein the primary sleeve includes a collar disposed on an uphole end of the primary sleeve, the collar having a recessed portion on an internal part of the collar.

6. The tool of claim 5 wherein the flapper is in a closed position when the primary sleeve is in its second position and a second sleeve is in its first position.

7. The tool of claim 1 further comprising a secondary flapper apparatus to provide at least one secondary flapper to further prevent the downhole tool from having fluid pass in the uphole direction therethrough.

8. The tool of claim 7 wherein the secondary flapper apparatus further includes a tertiary sleeve that extends uphole from a flapper housing and into the flapper valve assembly to maintain the flappers in an open position, the flapper housing having the at least one secondary flapper disposed therein.

9. The tool of claim 8 wherein the tertiary sleeve having a seat disposed therein to engage with a fluid blocking member to shift the tertiary secondary sleeve a certain distance in the downhole tool and within a cavity area disposed in the flapper housing.

10. The tool of claim 9 wherein the tertiary sleeve further includes a recessed area disposed thereon between a propped end and a body portion of the tertiary sleeve, the recessed area accepting a portion of a propped ball when the tertiary sleeve is shifted a certain amount in the downhole tool and the flapper housing.

11. A method, the method comprising:

positioning a downhole tool in a wellbore at a first location in the wellbore, the downhole tool comprising:

a flapper valve assembly for controlling the backflow of fluid into a tubing string, the flapper valve assembly includes at least one flapper;

a primary sleeve slidably disposed within at least a portion of the flapper valve assembly and the downhole tool;

a deformable seat disposed on an uphole end of the primary sleeve, the deformable seat having a secondary sleeve extending therefrom at least partially inside of the primary sleeve, the secondary sleeve flexes outward in a radial direction relative to the primary sleeve when a fluid blocking member is passed by the deformable seat; and a dissolvable fluid blocking member to engage with the seat to shift the primary sleeve from first position to a second position within the downhole tool, the dissolvable fluid blocking member dissolvable in a first dissolving solution; and shifting the primary sleeve in the downhole tool to interact with the flapper valve assembly.

12. The method of claim 11 wherein the deformable seat is dissolvable in a second dissolving solution.

13. The method of claim 12 further comprising the step of pumping the dissolvable fluid blocking member into the downhole tool to engage the seat and shift the primary sleeve in the downhole tool.

14. The method of claim 13 wherein the fluid blocking member is pumped past the seat and out of the downhole tool.

15. The method of claim 14 further comprising the step of pumping a dissolving solution to dissolve the dissolvable fluid blocking member or a portion of the seat.

16. The method of claim 11 wherein the downhole tool further comprises a secondary flapper apparatus.

17. The method of claim 16 further comprising the step of pumping a second fluid blocking member to engage the secondary flapper apparatus to shift the secondary flapper apparatus out of the downhole tool at the first location.

18. The method of claim 17 further comprising the step of moving the downhole tool to a second location in the wellbore after forcing the secondary flapper apparatus from the downhole tool.

19. The method of claim 18 further comprising the step of pumping the dissolvable fluid blocking member into the downhole tool to engage the seat and shift the primary sleeve in the downhole tool.

20. The method of claim 19 wherein the fluid blocking member is pumped past the seat and out of the downhole tool and a dissolving solution is pumped through the downhole tool to dissolve the dissolvable fluid blocking member or a portion of the seat.

* * * * *